US009322217B1

(12) United States Patent
Williams et al.

(10) Patent No.: US 9,322,217 B1
(45) **Date of Patent: *Apr. 26, 2016**

(54) DOWNHOLE ADJUSTABLE MUD MOTOR

(71) Applicants: Danny T. Williams, Katy, TX (US); Massoud Panahi, Katy, TX (US)

(72) Inventors: Danny T. Williams, Katy, TX (US); Massoud Panahi, Katy, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/800,646

(22) Filed: Jul. 15, 2015

Related U.S. Application Data

(63) Continuation of application No. 14/619,981, filed on Feb. 11, 2015, now Pat. No. 9,115,540.

(51) Int. Cl.

| | |
|---|---|
| ***E21B 7/06*** | (2006.01) |
| ***E21B 4/02*** | (2006.01) |
| ***E21B 3/00*** | (2006.01) |
| ***E21B 4/00*** | (2006.01) |

(52) U.S. Cl.
CPC . *E21B 7/067* (2013.01); *E21B 3/00* (2013.01); *E21B 4/003* (2013.01); *E21B 4/02* (2013.01); *E21B 7/068* (2013.01)

(58) Field of Classification Search
CPC ..... E21B 7/068; E21B 7/067; E21B 4/02
See application file for complete search history.

(56) References Cited

U.S. PATENT DOCUMENTS

| | | | |
|---|---|---|---|
| 4,729,675 | A | 3/1988 | Trzeciak et al. |
| 4,932,482 | A | 6/1990 | DeLucia |
| 5,090,497 | A | 2/1992 | Beimgraben et al. |
| 5,105,890 | A | 4/1992 | Duguid et al. |
| 5,265,687 | A | 11/1993 | Gray |
| 5,269,385 | A | 12/1993 | Sihlis |
| 5,311,952 | A | 5/1994 | Eddison et al. |
| 5,341,886 | A | 8/1994 | Patton |
| 5,439,064 | A | 8/1995 | Patton |
| 5,738,178 | A | 4/1998 | Williams et al. |
| 5,899,281 | A | 5/1999 | Gynz-Rekowski |
| 6,176,327 | B1 | 1/2001 | Hearn |
| 6,213,226 | B1 | 4/2001 | Eppink et al. |
| 6,554,083 | B1 | 4/2003 | Kerstetter |
| 6,629,571 | B1 | 10/2003 | Downie |
| 7,073,597 | B2 | 7/2006 | Williams |
| 7,096,979 | B2 | 8/2006 | Haci et al. |
| 7,222,675 | B2 | 5/2007 | Williams |
| 7,451,824 | B2 | 11/2008 | Williams |

(Continued)

FOREIGN PATENT DOCUMENTS

| | | | |
|---|---|---|---|
| GB | 2458909 | A | 7/2009 |

*Primary Examiner* — Giovanna C Wright
(74) *Attorney, Agent, or Firm* — Buskop Law Group, PC; Wendy Buskop

(57) ABSTRACT

A downhole adjustable mud motor for boring wellbores, such as a hole in the earth. The downhole adjustable mud motor has a progressive cavity power section with a power cavity end, wherein the progressive cavity power section has a rotor rotatably captured within a stator and a plurality of fluid flow paths between the stator and the rotor for flowing drilling fluid. A power transmission section can be connected to the power cavity end having a central axis and an offset axis. A first adjustable member can be fastened to the stator. A second adjustable member can have a locking member, a bearing assembly connecting to the transmission assembly, and a fastener operatively connected to the bearing assembly. The locking member prevents compression of the second adjustable member inside of the first adjustable member when drilling fluid flows through the downhole adjustable mud motor.

18 Claims, 7 Drawing Sheets

(56) References Cited

U.S. PATENT DOCUMENTS

| | | | | |
|---|---|---|---|---|
| 8,118,103 | B2 | 2/2012 | Williams | |
| 9,115,540 | B1 * | 8/2015 | Williams et al. | E21B 7/068 |
| 2002/0166701 | A1 | 11/2002 | Comeau et al. | |
| 2004/0222023 | A1 | 11/2004 | Haci et al. | |
| 2004/0262043 | A1 | 12/2004 | Schuaf | |
| 2009/0057028 | A1 | 3/2009 | Williams | |
| 2011/0061938 | A1 | 3/2011 | Miszewski | |
| 2011/0120775 | A1 | 5/2011 | Krueger et al. | |
| 2012/0048569 | A1 | 3/2012 | Williams | |
| 2013/0051716 | A1 | 2/2013 | Cioceanu | |
| 2013/0264067 | A1 | 10/2013 | Williams | |
| 2013/0319764 | A1 | 12/2013 | Schaaf et al. | |
| 2014/0360787 | A1 | 12/2014 | Williams | |

* cited by examiner

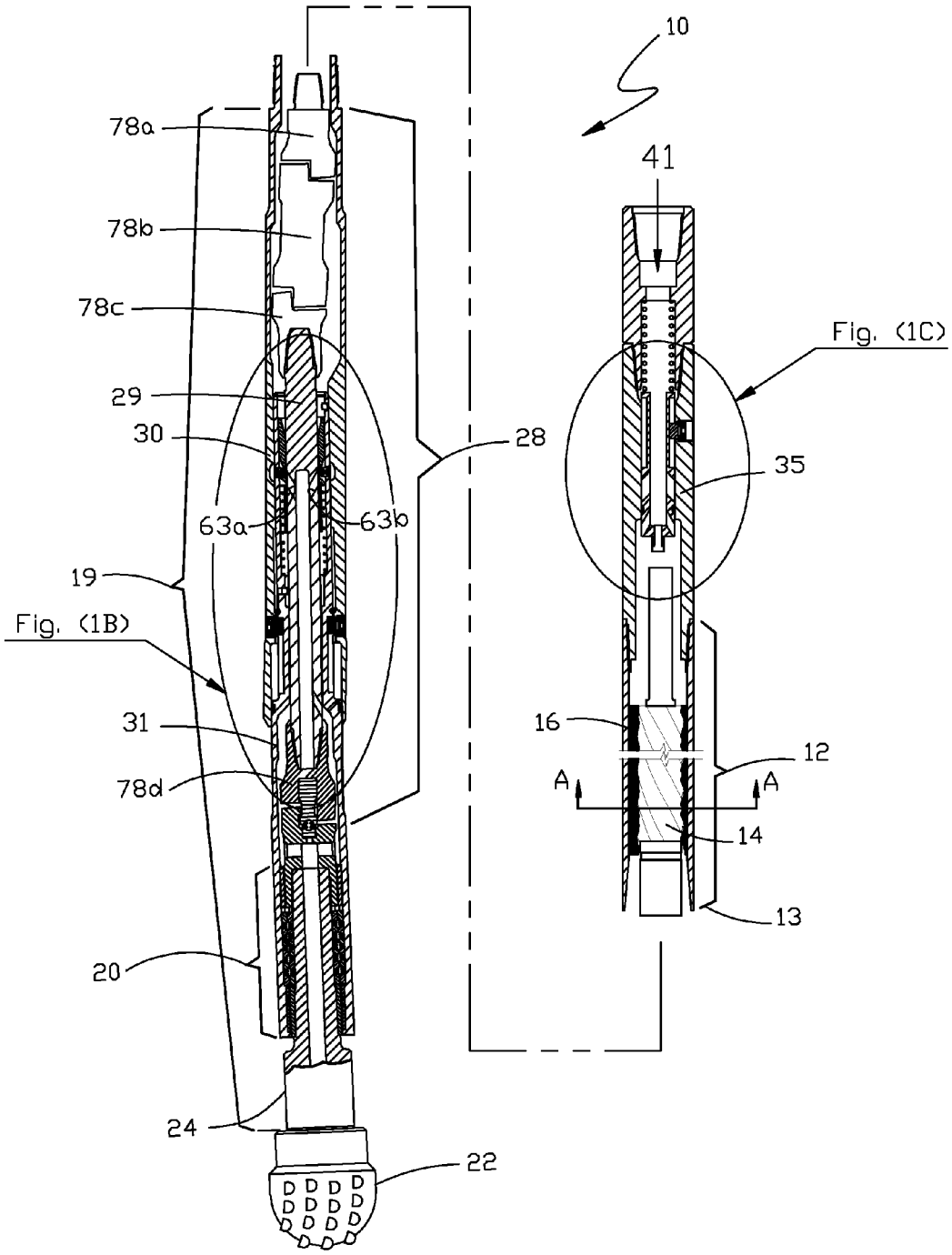
Fig. (1A)

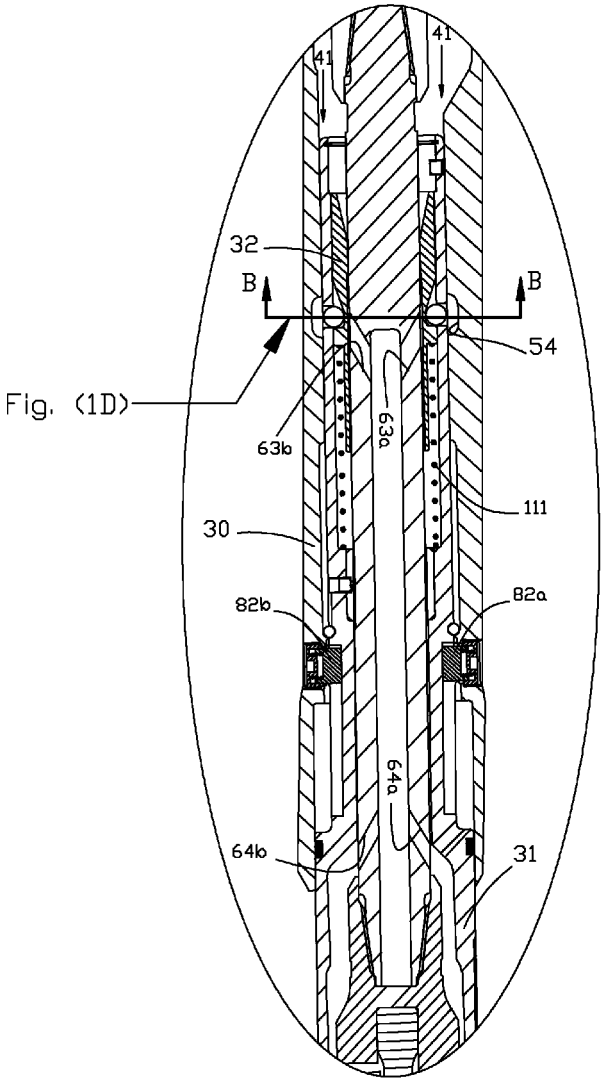
Fig. (1B)
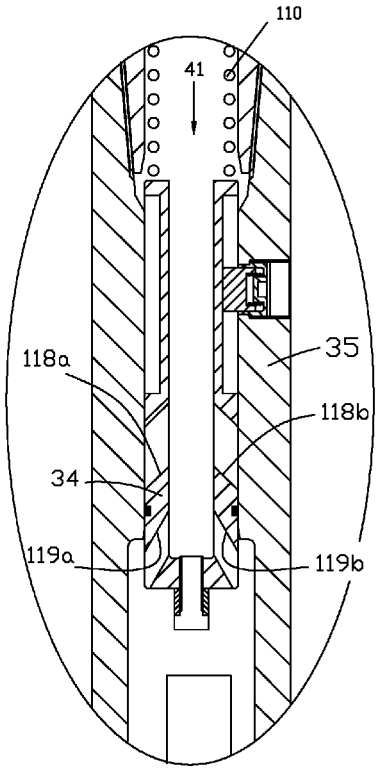
Fig. (1C)

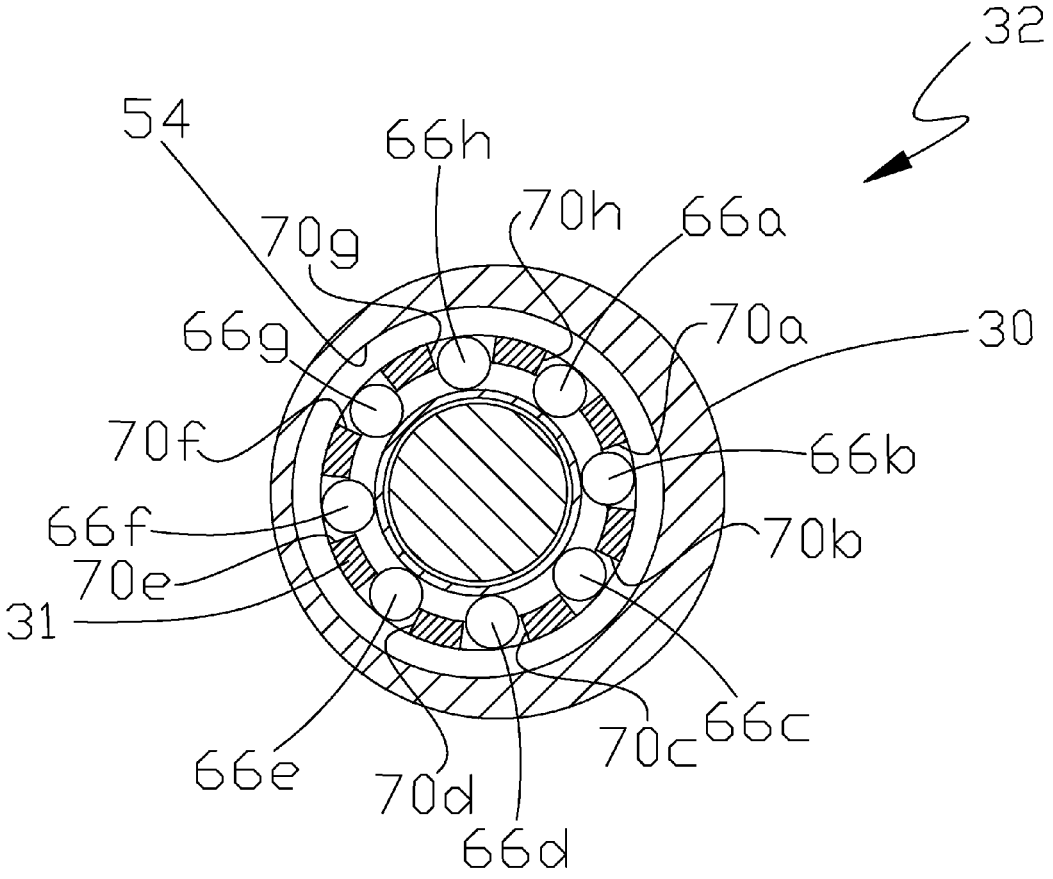
B-B VIEW
Fig. (1D)

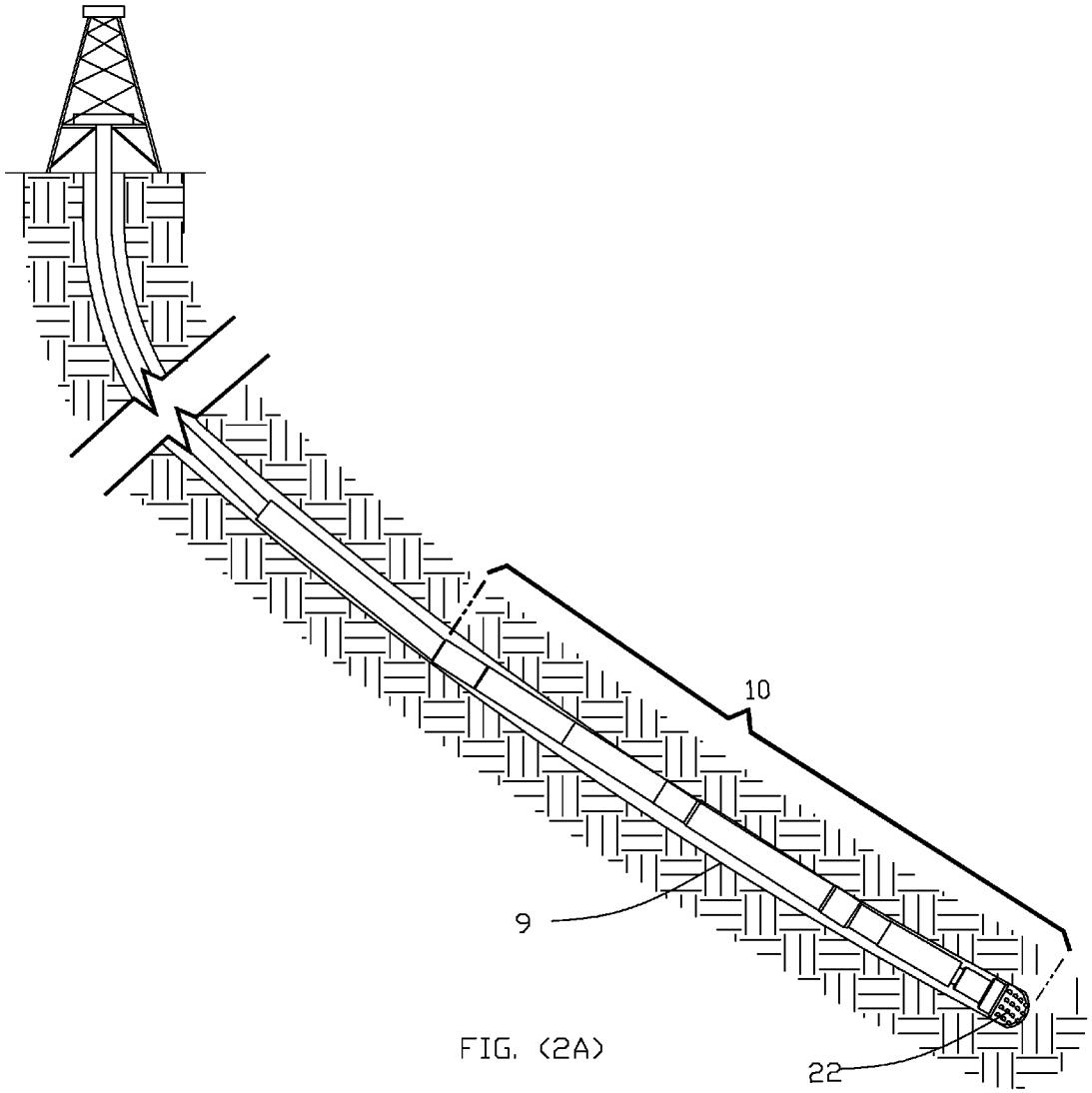
FIG. (2A)

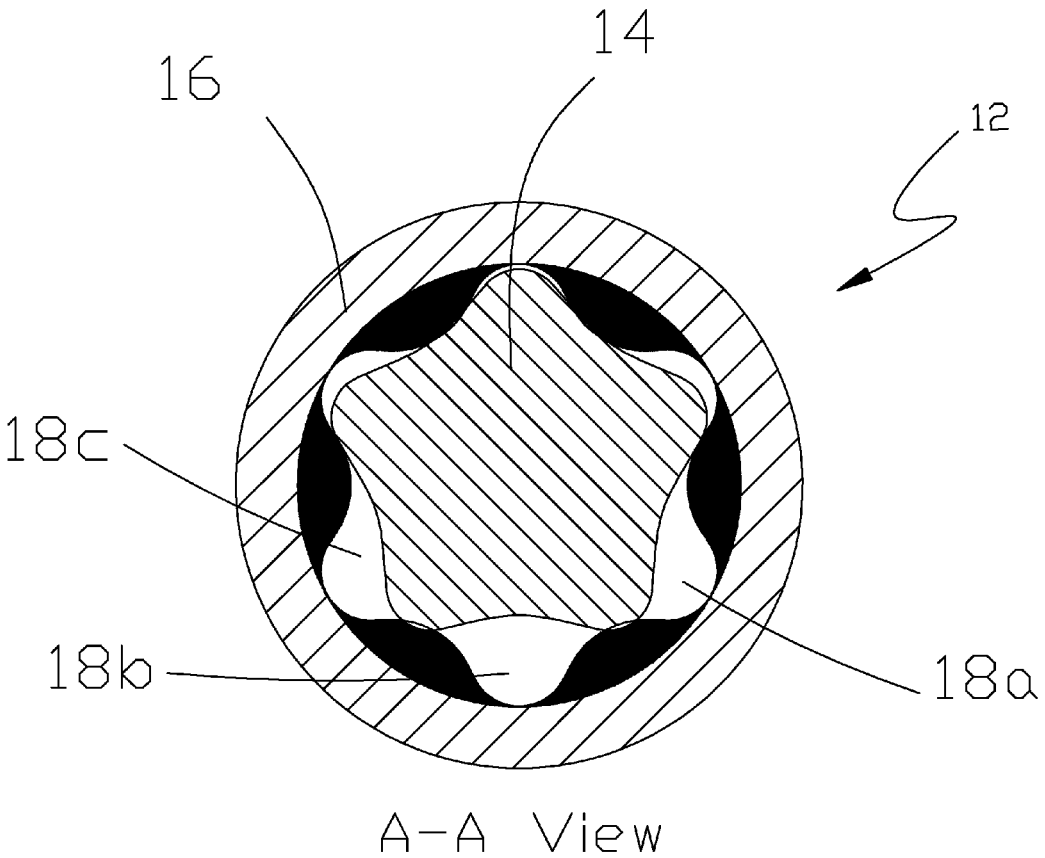
Fig. (2B)

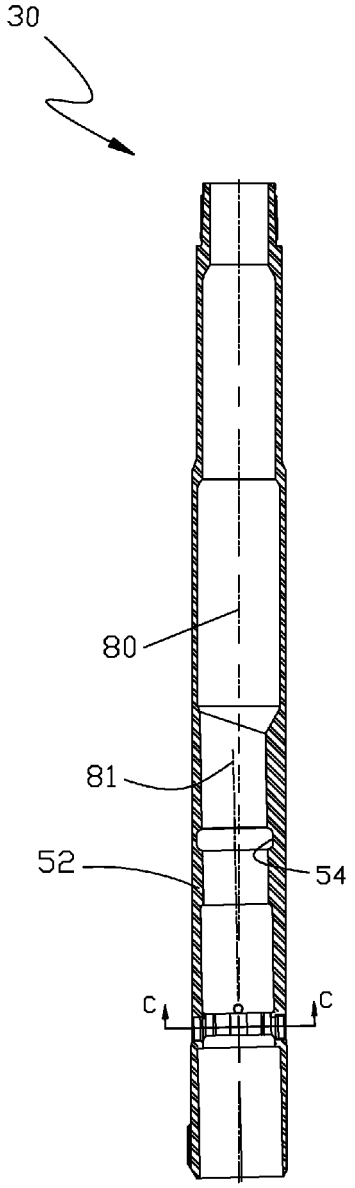
Fig. (3A)
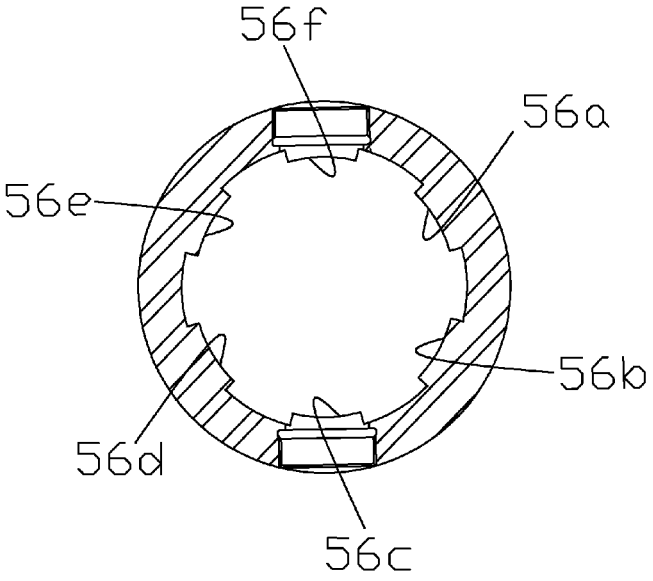
C-C VIEW
Fig. (3B)

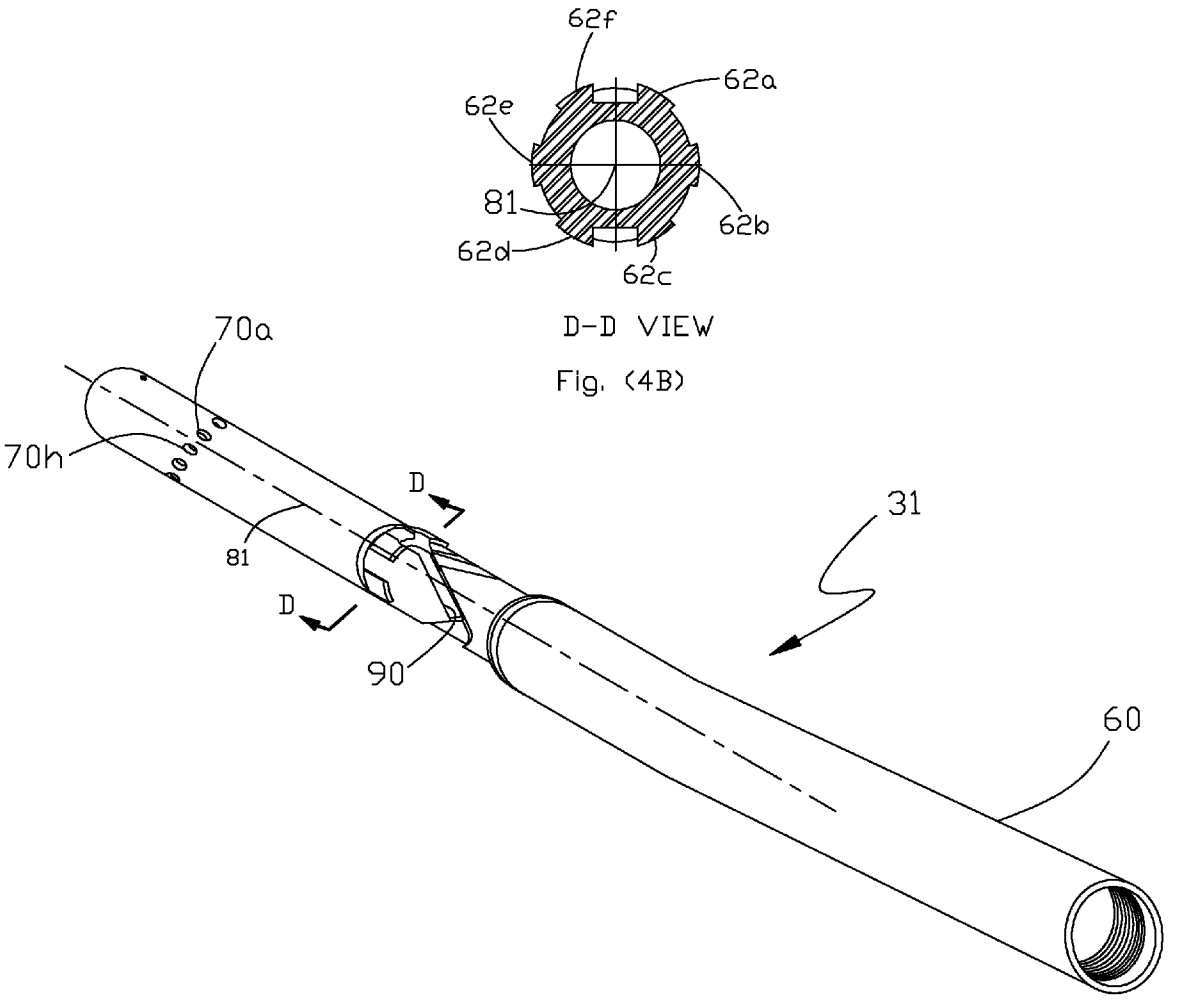
Fig. (4A)

DOWNHOLE ADJUSTABLE MUD MOTOR

CROSS REFERENCE TO RELATED APPLICATION

The current application is a Continuation and claims priority to co-pending U.S. patent application Ser. No. 14/619,981 filed on Feb. 11, 2015, entitled "DOWNHOLE ADJUSTABLE MUD MOTOR". This reference is hereby incorporated in its entirety.

FIELD

The embodiments generally relate to a downhole adjustable mud motor.

BACKGROUND

A need exists for a downhole adjustable mud motor that can minimize trips in and out of a wellbore.

The present embodiments meet these needs.

BRIEF DESCRIPTION OF THE DRAWINGS

The detailed description will be better understood in conjunction with the accompanying drawings as follows:

FIG. 1A depicts a downhole adjustable mud motor according to one or more embodiments.

FIG. 1B is an enlarged detail view of a second adjustable member connected to a first adjustable member according to one or more embodiments.

FIG. 1C is an enlarged detail view of a pressure control valve in a sub according to one or more embodiments FIG. 1D is a cut view of the locking member with a plurality of moveable locking balls and a plurality of pockets according one or more embodiments.

FIG. 2A depicts the downhole adjustable mud motor in a wellbore according to one or more embodiments.

FIG. 2B shows a cut view of the progressive cavity power section with at least one fluid path according to one or more embodiments.

FIG. 3A depicts the first adjustable member according to one or more embodiments.

FIG. 3B shows a cut view along line C-C of FIG. 3A of the first adjustable member according to one or more embodiments.

FIG. 4A is a perspective view of the second adjustable member with a permanent bend according to one or more embodiments.

FIG. 4B is a cut view along line D-D of FIG. 4A of the second adjustable member according to one or more embodiments.

The present embodiments are detailed below with reference to the listed Figures.

DETAILED DESCRIPTION OF THE EMBODIMENTS

Before explaining the apparatus in detail, it is to be understood that the apparatus is not limited to the particular embodiments and that it can be practiced or carried out in various ways.

The embodiments relate to a downhole adjustable mud motor, which can be used for boring a hole into the earth.

A benefit of the invention is that the embodiments can reduce drill string tripping in an out of the wellbore. The present invention can reduce the number of well blowouts which can occur during tripping in and out of the wellbore and cause loss of life and pollution of hazardous material.

Currently, in the directional and horizontal drilling industry, controlling wellbore trajectory involves steering the downhole adjustable mud motor by sliding (non-rotation of the drill string and bottom hole assembly "BHA") the bend of the downhole adjustable mud motor in the direction desired to make a direction (left or right) or angle change (up or down). This type of drilling is commonly called slide drilling. Once this change is made the drill string is rotated from the surface with a bottom hole assembly (BHA) between the drill string and the operating member to hold the wellbore change just made. This type of drilling is commonly called rotary drilling. Slide drilling changes are typically accomplished from a predetermined bend in the downhole adjustable mud motor that is set at the surface. Currently, this predetermined bend can only be changed by pulling out of hole "POOH" to the BHA and manually making the change using the surface-adjustable bent housing.

Some of the many issues created from the above process are poor hole cleaning, increased rig time to change a bend, torque and drag issues, POOH to change BHA from curve to lateral section, premature drill bit wear and lower rates of penetration, low build rates and no control over changes in the drilling environment.

Hole cleaning issues are normally created by the drilled cuttings dropping to the bottom of the wellbore because of higher wellbore angles, insufficient flow rates, and gravity. By rotating a bent member, the wellbore also produces a swirling pattern that causes periodic cutting traps along the wellbore path to the surface.

Swirling patterns are often created on the bottom and top of the wellbore. These periodic swirling valleys create drill cutting traps that will not allow large portions of drill cuttings to exit the wellbore. The swirling patterns also create torque and drag issues while in the sliding and rotary drilling mode. In addition, this swirling wellbore causes higher friction coefficients when running production casing.

The invention creates a smooth contour within the wellbore. With the smooth contour, higher rotational speeds during rotary drilling are achieved with the downhole adjustable mud motor and create the scooping mechanism needed to lift drill cuttings off the bottom of the wellbore and spin them to the top, where the majority of the drill mudflow velocities are located. This enables a well to be drilled quicker and cleaner.

Higher rotational speeds needed in the rotary drill mode to clean the wellbore are not obtainable with a bent downhole adjustable mud motor due to stress and torque limitations. Higher rotational speeds are attainable with a straight downhole adjustable mud motor rotated in the wellbore. The invention is to create a downhole adjustable mud motor that can move from bent (for slide drilling) to straight (for rotary drilling) to create a clean wellbore using higher rotational speeds.

Any increase in non-drilling time is a direct increase to the cost function for any companies exploration cost. Oil and gas companies strive to reduce any non-drilling time, such as POOH to make BHA changes, short trips due to hole cleaning and torque and drag. Some of the reasons for POOH that this invention solves are short trips due to poor hole cleaning, changing the bend due to low build rates, changing from the curve BHA bend to a horizontal BHA bend, to transition from drilling cement and casing shoe BHA to the directional drilling BHA, and to reduce the need of making wiper trips to run the final production casing in the wellbore. All of these cause non-drilling direct cost function increases. This invention eliminates these direct cost function increases.

Finally, a drill bit rotated on a bent downhole adjustable mud motor can cause excessive and unnecessary side load wear. The whirling of the drill bit on the end of the bent downhole adjustable mud motor in the rotary drilling mode causes this side load to occur. Taking out the bent member while in the rotary drilling mode and using a straight downhole adjustable mud motor will increase the rate of penetration and life of the drill bit. This invention is capable of doing this downhole in the wellbore without POOH to change the BHA at the surface.

The embodiments relate to a downhole adjustable mud motor for boring a hole, such as a wellbore.

The downhole adjustable mud motor can have a progressive cavity power section with a power cavity first end.

The progressive cavity power section can have a rotor, which can be rotatably captured within a stator. The progressive cavity power section can have a plurality of fluid flow paths between the stator and the rotor for flowing drilling fluid from surface fluid pumps, which in embodiments, can be mud pumps.

A power transmission section can be connected to the power cavity first end. The power transmission section can have an axis and an offset axis. The power transmission section can have a transmission assembly engaging the rotor.

The term "transmission assembly" as used herein can refer to a transmission coupling that can absorb eccentric motion from the rotor and transfers the eccentric motion as concentric motion to the bearing assembly. The transmission assembly can transfer power and torque from the power section to the operating member through the bearing assembly.

The term "adjustable member" as used herein can refer to one or more lower cylindrical housings below the progressive cavity power section. The lower cylindrical housings can be connected together in series. The connected lower cylindrical housings can have a length from approximately 5 feet to 20 feet.

A first adjustable member can be fastened to the stator.

In embodiments, the rotor can have from 1 lobe to 9 lobes. In embodiments, the stator can have from 2 lobes to 10 lobes.

In embodiments, the stator and the rotor can have a stage from 1 stage to 20 stages.

In embodiments, the downhole adjustable mud motor can use a plurality of stators and a plurality of rotors.

A second adjustable member can be configured to simultaneously slide and rotate within the first adjustable member.

In embodiments, the second adjustable member can have a locking member. In embodiments, the second adjustable member can have a bearing assembly that can connect to the transmission assembly A fastener can be operatively connected to the bearing assembly. The fastener can engage an operating member, such as a drill bit, enabling the downhole adjustable mud motor to operate the operating member.

The second adjustable member can be configured to compress inside of the first adjustable member when weight is applied to the operating member and no drilling fluid is flowing through the downhole adjustable mud motor.

The second adjustable member can be configured to expand from the first adjustable member when drilling fluid flows through the downhole adjustable mud motor to the operating member engaging the locking member, wherein the locking member can prevent compression of second adjustable member inside of the first adjustable member, when drilling fluid flows through the downhole adjustable mud motor.

In embodiments, the downhole adjustable mud motor can have a pressure control valve located in a sub. In embodiments, the sub can be fasted to the stator.

The pressure control valve can be configured to receive drilling fluid from a surface location and transfer the drilling fluid to the stator.

The pressure control valve can have a first position for receiving drilling fluid from a first pair of flow ports and a second pair of flow ports. In embodiments, the pressure control valve can have a second position for receiving drilling fluid from only the second pair of flow ports.

The pressure control valve creating a pressure differential that indicates an angular position between a first adjustable member and a second adjustable member.

In embodiments, the operating member can include a fastener to engage the power transmission section, wherein the fastener can comprise a bit box, a box fitting or a pin connection.

In embodiments, the operating member can be a drill bit or a heating element.

In embodiments, the second adjustable member can rotate within the first adjustable member from about 0 degrees to about 90 degrees along the offset axis.

In embodiments, the second adjustable member can slide within the first adjustable member, along the offset axis from about 5 inches to about 60 inches.

In embodiments, each of the fluid flow paths of the plurality of fluid flow paths can transfer drilling fluid at a rate from about 60 gallons per minute to about 2,000 gallons per minute.

In embodiments, the first adjustable member can be disposed partially around the axis, and partially around the offset axis. In embodiments, the first adjustable member can have a first cylindrical housing containing a plurality of first splines, wherein the plurality of first splines can be configured to bi-directionally move parallel to the axis.

In embodiments, the first cylindrical housing can have a grooved inner surface.

In embodiments, the second adjustable member can be disposed around the offset axis. In embodiments, the second adjustable member can have a second cylindrical housing, wherein the second cylindrical housing containing a plurality of second splines, wherein the plurality of second splines can be configured to rotate around the offset axis to align and interlock with the plurality of first splines.

In embodiments, the plurality of second splines can create a rotational lock with the plurality of first splines simultaneously preventing rotational movement of the first and second adjustable members.

In embodiments, the first and second cylindrical housings can comprise steel, stainless steel, tungsten carbide, reinforced fiberglass, graphic composite, copper, alloys thereof, similar materials known in the industry and combinations thereof.

In embodiments, the first and second cylindrical housings can range from 4 feet to 60 feet in length.

In embodiments, the second cylindrical housing can be angled from 0.01 degrees to 10 degrees from the offset axis.

In embodiments, the locking member can have a plurality of moveable locking balls, wherein each moveable locking ball can be moveably installed in one of a plurality of pockets in the second adjustable member.

In embodiments, each moveably locking ball can be adapted to move partially from the pocket to completely lock with the grooved inner surface of the first adjustable member preventing axial movement of both the first and second adjustable members.

In embodiments, the transmission assembly can comprise a connecting rod. In embodiments, the connecting rod can engage bearing assembly through a plurality of flexible couplings.

In embodiments, the locking member can be a locking sleeve that slides inside second adjustable member over the connecting rod.

In embodiments, a plurality of helical stepped channels can be formed in the second adjustable member.

In embodiments, a plurality of detent pucks can be in the first adjustable member, wherein each detent puck can rotate the second adjustable member when the drilling fluid flows in the channel, and the steps of the helical stepped channel can prevent the detent pucks from moving bi-directionally.

Referring now to the Figures, FIG. 1A depicts a downhole adjustable mud motor according to one or more embodiments.

The downhole adjustable mud motor 10 can be a two part downhole adjustable mud motor that can engage an operating member 22 which can include a drill bit as shown.

The first section of the downhole adjustable mud motor 10 can be a power transmission section 19 that can connect on one end to the operating member 22 and on the other end to a progressive cavity power section 12.

The power transmission section 19 can have a fastener 24 for engaging the operating member 22.

In embodiments, the fastener can be a box fitting, a welded tube, or a pin fitting.

The power transmission section 19 can contain a bearing assembly 20 connected to the fastener 24.

In embodiments, a usable bearing assembly can have radial and axial bearings. The bearings can be tungsten carbide steel, ceramic, polycrystalline diamond, or another non-deforming material, and combinations thereof The bearing assembly 20 can connect between a second adjustable member 31 and the fastener 24.

In embodiments, the second adjustable member 31 can be from 6 feet to 60 feet long, with an inner diameter ranging from 1 inch to 20 inches and can be made from carbon steel, tungsten steel or a non-magnetic rigid durable material capable of withstanding temperatures exceeding 500 Fahrenheit and pressure of up to 50,000 psi.

The second adjustable member 31 can slide into of a first adjustable member 30.

In embodiments, the first adjustable member 30 can be from 6 feet to 60 feet long, with an inner diameter ranging from 1 inch to 20 inches and can be made from carbon steel, tungsten steel or a non-magnetic rigid durable material capable of withstanding temperatures exceeding 500 Fahrenheit and pressure of up to 50,000 psi.

A plurality of flexible couplings 78*a*, 78*b*, and 78*c* can connect to each other forming a coupling string. On one end of the coupling string, the coupling string can engage a power cavity first end 13 of a progressive cavity power section 12 which can engage a sub 35.

On the other end, the flexible coupling string can engage a connecting rod 29.

In embodiments, examples of the flexible couplings can be ball and joint lobe couplings, CV joint couplings, flex shaft couplings, or cylindrical flexible segments, such as those made of carbon steel, tungsten carbide, beryllium copper, or similar alloys.

In embodiments, the connecting rod 29 can be from 1 foot to 10 feet long, and can have an outer diameter from 1 inch to 20 inches. In embodiments, the connecting rod can be hollow with at least two inlet ports 63*a* and 63*b*

In embodiments, the inside of the downhole adjustable mud motor 10 can have the connecting rod 29 that internally connects the plurality of flexible couplings 78*a*, 78*b*, and 78*c* from a rotor 14, the progressive cavity power section 12 to a flexible coupling 78*d* of the bearing assembly 20, and ultimately an operating member, such as the drill bit.

The connecting rod 29 can have a bore that allows drilling fluid 41 to flow to the operating member, such as the drill bit.

The connecting rod 29 can have at least one inlet port 63*a* and 63*b* and at least one outlet port, which is shown in FIG. 1B.

In embodiments, the connecting rod 29 can be threaded between at least two of the plurality of flexible couplings 78*c* and 78*d*.

The second adjustable member 31 can simultaneously slide and rotate within the first adjustable member 30.

The first adjustable member 30 of the power transmission section 19 can couple to a stator 16 in the progressive cavity power section 12.

In embodiments, the progressive cavity power section 12 can have the rotor 14 rotatably captured within a stator 16 and the sub 35 engaged to an upper housing of the progressive cavity power section 12.

In embodiments, a transmission assembly 28 can engage the rotor 14.

In embodiments, a transmission assembly 28 can connect between all flexible couplings 78*a*, 78*b*, 78*c*, and 78*d* and the connecting rod 29.

FIG. 1B is an enlarged detail view of a second adjustable member connected to a first adjustable member according to one or more embodiments.

The second adjustable member 31 is shown extending inside the first adjustable member 30.

The second adjustable member 31 can be configured to simultaneously compress and rotate within the first adjustable member 30 when the surface pump pressure is off and weight is applied to the operating member.

The second adjustable member 31 can rotate and extends out when drilling fluid 41 is applied from the surface through the downhole adjustable mud motor to the operating member.

Every rotational cycle of the compression and expansion between the second adjustable member 31 and the first adjustable member 30 can cause a different bend to bend or bend to straight position of the downhole adjustable mud motor.

In embodiments, whenever drill fluid 41 is active, a locking member 32 can be engaged to prevent any compression of the second adjustable member 31 inside of the first adjustable member 30.

In embodiments, when the surface fluid pumps are off, internal pressure reduces causing a spring 111 to push the locking member 32 up and can release or disengage a plurality of moveable locking balls from a plurality of pockets, shown in FIG. 1D.

The downhole adjustable mud motor can have a plurality of helical stepped channels, which are shown in FIG. 4A. In each of the helical stepped channels can be at least one detent puck, a plurality of detent pucks 82*a* and 82*b* are shown.

The detent pucks can rotate the second adjustable member 31 against the first adjustable member.

The steps of the helical stepped channels prevent the detent pucks from moving bi-directionally keeping the rotation in one direction only.

Also shown is a grooved inner surface 54.

FIG. 1C is an enlarged detail view of a pressure control valve in the sub according to one or more embodiments The pressure control valve 34 which can be located in the sub 35. The sub 35 can be secured to the top of the stator.

The pressure control valve 34 can be configured to receive drilling fluid 41 from a surface location and transfer the drilling fluid 41 to the stator.

The pressure control valve 34 can initially be configured in a first position when the downhole adjustable mud motor is in a straight position and can be moveable to a second position when the downhole adjustable mud motor is in a bent position.

The pressure control valve 34 can form a pressure differential that indicates an extension of the second adjustable member from the first adjustable member.

The differential pressure indicates that an angle can be created between the first and second adjustable members.

In embodiments, the components of the sub 35 can include a compression spring 110, the pressure control valve 34, and a first pair of flow ports 118*a* and 118*b* and a second pair of flow ports 119*a* and 119*b*.

The pressure control valve 34 can have a first position for receiving drilling fluid from the first pair of flow ports 118*a* and 118*b* and the second pair of flow port 119*a* and 119*b* and a second position for receiving drilling fluid from only the second pair of flow ports 119*a*, and 119*b*, wherein the pressure control valve creates a pressure differential that indicates an angular position between the first adjustable member and the second adjustable member 31.

When the surface fluid pumps are off and the downhole adjustable mud motor can be lowered to the bottom of the wellbore, the internal movement of the rotor can be the setting and unsetting device of the pressure control valve 34 which can produce a pressure differential indicating a setting of the downhole adjustable mud motor.

As drilling fluid 41 passes through the inner diameter of the sub 35, the drilling fluid reaches the first pair of flow ports 118*a* to 118*d* and continues past the top of the rotor through the progressive power section down through the downhole adjustable mud motor to the locking member.

The pressure control valve 34 can initially be configured in a first position when the downhole adjustable mud motor is in a straight position and can be moveable to a second position when the downhole adjustable mud motor is in a bent position.

The drilling fluid pushes the locking member down and can open the inlet ports 63*a* and 63*b*. Drilling fluid flow can exit the connecting rod 29 through outlet ports 64*a* and 64*b* to the bearing assembly and out the operating member, such as the drill bit.

The inlet ports can be open to allow more flow and less pressure inside the downhole adjustable mud motor.

FIG. 1D is a cut view of the locking member with a plurality of moveable locking balls and a plurality of pockets according one or more embodiments.

The locking member 32 can have a plurality of moveable locking balls 66*a*-66*h* and a plurality of pockets 70*a*-70*h*.

In embodiments, the plurality of moveable locking balls 66*a*-66*h* can be located in the second adjustable member 31 for engaging the plurality of pockets 70*a*-70*h*, which can be formed in the first adjustable member 30.

Pressure from the drilling fluid can simultaneously move the plurality of moveable locking balls 66*a*-66*f* to lock into the grooved inner surface 54 locking the first adjustable member 30 to the second adjustable member to prevent axial movement of both the first adjustable member and the second adjustable member.

In embodiments, the grooved inner surface 54 can be a circular recess on the inside diameter of the first adjustable member 30 to accept the plurality of moveable locking balls 66*a*-66*h*.

FIG. 2A depicts a downhole adjustable mud motor in a wellbore according to one or more embodiments.

The downhole adjustable mud motor 10 is shown in a wellbore, such as a hole 9. The operating member 22 is also depicted.

FIG. 2B shows a cut view of the progressive cavity power section with at least one fluid path according to one or more embodiments.

In embodiments, the progressive cavity power section 12 can have at least one fluid flow path between the stator 16 and the rotor 14. In this embodiment, the progressive cavity power section 12 is shown with three fluid flow paths 18*a*, 18*b*, and 18*c*.

FIG. 3A shows a cut view of the first adjustable member according to one or more embodiments.

The first adjustable member 30 can be disposed partially around an axis 80 and partially around an offset axis 81.

The first adjustable member 30 can have a first cylindrical housing 52.

The grooved inner surface 54 is also shown.

FIG. 3B shows a cut view along line C-C of FIG. 3A of the first adjustable member according to one or more embodiments.

The first cylindrical housing can contain a plurality of first splines 56*a*-56*f*.

The plurality of first splines can be configured to bi-directionally move parallel to the central axis.

FIG. 4A is a perspective view of the second adjustable member with a permanent bend according to one or more embodiments.

The second adjustable member 31 can have a second cylindrical housing 60.

The second adjustable member 31 can be disposed around the offset axis 81 and a plurality of helical stepped channels 90.

FIG. 4B is a cut view along line D-D of FIG. 4A of the second adjustable member according to one or more embodiments.

The second cylindrical housing can contain a plurality of second splines 62*a*-62*f*.

The plurality of second splines can be configured to rotate around the offset axis to align and interlock with the plurality of first splines.

The plurality of second splines can create a rotational lock with the plurality of first splines simultaneously preventing rotational movement of the first and second adjustable members.

In embodiments, the second adjustable member can rotate within the first adjustable member from 0 degrees to 90 degrees when compressed, then can rotate from 90 degrees to 180 degrees when extended.

In embodiments, the second adjustable member can slide within the first adjustable member, from approximately 5 inches to 10 inches.

In embodiments, the progressive cavity power section can be formed from two cylindrical housings, which can be made from steel, stainless steel, tungsten carbide, reinforced fiberglass, graphic composite, copper, alloys thereof, and combinations thereof.

In embodiments, the downhole adjustable mud motor can range in overall length from 4 feet to 60 feet.

In embodiments, the downhole adjustable mud motor can have one or more bent settings to create a bent steerable downhole adjustable mud motor or a straight downhole adjustable mud motor from the same piece of equipment.

In embodiments, the downhole adjustable mud motor can have a pressure increase and locking sleeve mechanism to indicate when the downhole adjustable mud motor is bent or straight and to lock the downhole adjustable mud motor in either a bent or straight position as long as pumps are running.

As an example of the method of using and/or operating the downhole adjustable mud motor, the method can include lifting the downhole adjustable mud motor away from the bottom of the wellbore or other hole in the earth.

The method can include turning off the surface pumps pumping drilling fluid down the hole The method can include lowering the downhole adjustable mud motor to the bottom of the wellbore or hole.

In embodiments, the method can include applying from 2,000 pounds to 3,000 pounds of drill string weight to compress the second adjustable member inside of the first adjustable member.

While the compression of the second adjustable member occurs, the transmission assembly and the rotor can be pushed into the pressure control valve, wherein the pressure control valve can close the flow ports.

The method can include lifting the downhole adjustable mud motor away from the bottom of the wellbore or hole, and the surface pumps can be turned on to deliver drilling fluid to the pressure control valve, the progressive cavity power section and the rotor, which can cause the second adjustable member to fully extend away from the first adjustable member and force the locking mechanism to seat the plurality of moveable locking balls against the grooved inner surface of the first adjustable member.

The downhole adjustable mud motor can now be locked in a bend position and ready to slide or rotary drill.

Once target drilling depth has been achieved in the hole, the downhole adjustable mud motor is lifted off the bottom of the wellbore or hole.

The surface pumps pumping drilling fluid are again turned off.

The downhole adjustable mud motor can then be lowered to the bottom of the wellbore or hole and drill string weight can be applied to compress the second adjustable member against the first adjustable member which moves the transmission assembly and the rotor into the pressure control valve.

The surface pumps can then be turned back on, pumping drilling fluid downhole to the pressure control valve and the rotor causing the second adjustable housing to extend from the first adjustable housing to set the locking member. The locking member sets the plurality of moveable locking balls against the grooved inner surface causing a differential pressure reduction that indicates the downhole adjustable mud motor is in an altered position, different from the initial position, such as straight instead of bent, bent instead of straight, or bent at another angle from the first bent position.

The downhole adjustable mud motor is now ready to drill.

While these embodiments have been described with emphasis on the embodiments, it should be understood that within the scope of the appended claims, the embodiments might be practiced other than as specifically described herein.

What is claimed is:

1. A downhole adjustable mud motor for boring a hole in the earth comprising:

a. a progressive cavity power section with a power cavity first end, the progressive cavity power section comprising:
   1. a rotor rotatably captured within a stator; and
   2. a plurality of fluid flow paths between the stator and the rotor for flowing drilling fluid; and b. a power transmission section connected to the power cavity first end, having an axis and an offset axis, the power transmission section comprising:
   1. a transmission assembly engaging the rotor;
   2. a first adjustable member fastened to the stator;
   3. a second adjustable member configured to simultaneously slide and rotate within the first adjustable member, wherein the second adjustable member comprising a locking member;
   4. a bearing assembly connected to the transmission assembly; and
   5. a fastener operatively connected to the bearing assembly; and c. a pressure control valve located in a sub, wherein the sub is fastened to the stator, wherein the pressure control valve is configured to receive the drilling fluid from a surface location and transfer the drilling fluid to the stator.

2. The downhole adjustable mud motor of claim 1, wherein the fastener engages an operating member enabling the downhole adjustable mud motor to operate the operating member.

3. The downhole adjustable mud motor of claim 1, wherein the pressure control valve having a first position for receiving the drilling fluid from a first pair of flow ports and a second pair of flow ports and a second position for receiving the drilling fluid from only the second pair of flow ports, and further wherein the pressure control valve creating a pressure differential that indicates an angular position between the first adjustable member and the second adjustable member.

4. The downhole adjustable mud motor of claim 1, wherein the operating member includes the fastener to engage the power transmission section, wherein the fastener comprises a bit box, a box fitting, or a pin connection.

5. The downhole adjustable mud motor of claim 1, wherein the operating member is a drill bit or a heating element.

6. The downhole adjustable mud motor of claim 1, wherein the second adjustable member rotates within the first adjustable member from 0 degrees to 90 degrees along the offset axis.

7. The downhole adjustable mud motor of claim 1, wherein the second adjustable member slides within the first adjustable member along the offset axis from 5 inches to 60 inches.

8. The downhole adjustable mud motor of claim 1, wherein the rotor comprises from a 1 lobe to a 9 lobe rotor.

9. The downhole adjustable mud motor of claim 1, wherein the stator and the rotor comprise a stage from 1 stage and 20 stages.

10. The downhole adjustable mud motor of claim 1, wherein the stator comprises from 2 lobes to 10 lobes.

11. The downhole adjustable mud motor of claim 1, wherein the stator is a plurality of stators and the rotor is a plurality of rotors.

12. The downhole adjustable mud motor of claim 1, wherein each of the fluid flow paths of the plurality of fluid flow paths transfer the drilling fluid at a rate from 60 gallons per minute to 2,000 gallons per minute.

13. The downhole adjustable mud motor of claim 1, wherein the first adjustable member is disposed partially around a central axis and partially around the offset axis, the first adjustable member has a first cylindrical housing containing a plurality of first splines, wherein the plurality of first splines are configured to bi-directionally move parallel to the central axis, and wherein the first cylindrical housing further comprises a grooved inner surface.

14. The downhole adjustable mud motor of claim 13, wherein the second adjustable member is disposed around the offset axis, the second adjustable member having a second cylindrical housing, the second cylindrical housing containing a plurality of second splines, wherein the plurality of second splines are configured to rotate around the offset axis to align and interlock with the plurality of first splines, further wherein the plurality of second splines create a rotational lock with the plurality of first splines simultaneously preventing rotational movement of the first adjustable member and the second adjustable member.

15. The downhole adjustable mud motor of claim 1, wherein the locking member comprises a plurality of moveable locking balls, wherein each moveable locking ball of the plurality of moveable locking balls is installed in one of a plurality pockets in the second adjustable member, each moveably locking ball of the plurality of moveable locking balls is adapted to move partially from each of the pockets of the plurality of pockets to completely lock with a grooved inner surface of the first adjustable member preventing axial movement of both the first adjustable member and the second adjustable member.

16. The downhole adjustable mud motor of claim 1, wherein the transmission assembly comprises a connecting rod, wherein the connecting rod engaging the bearing assembly through a plurality of flexible couplings.

17. The downhole adjustable mud motor of claim 1, wherein the locking member is a locking sleeve that slides inside the second adjustable member over a connecting rod.

18. The downhole adjustable mud motor of claim 1, comprising a plurality of helical stepped channels in the second adjustable member, a plurality of detent pucks in the first adjustable member, wherein each detent puck of the plurality of detent pucks is from the first adjustable member and rotates the second adjustable member when the drilling fluid flows in each helical stepped channels in the plurality of helical stepped channels, and steps of the plurality of helical stepped channels prevent the detent pucks from moving bi-directionally.

* * * * *